United States Patent [19]

Uchida et al.

[11] 4,219,985

[45] Sep. 2, 1980

[54] COIN PACKAGING MACHINE

[75] Inventors: Isamu Uchida; Kenkichi Watanabe; Yorizo Miyazaki, all of Tokyo, Japan

[73] Assignees: Laurel Bank Machine Co., Ltd., Tokyo, Japan; Laurel Bank Machine Co., Ltd., Tokyo, Japan

[21] Appl. No.: 932,603

[22] Filed: Aug. 10, 1978

[30] Foreign Application Priority Data

Aug. 11, 1977 [JP] Japan ..... 52-96417

[51] Int. Cl.[2] ..... B65B 11/04

[52] U.S. Cl. ..... 53/212

[58] Field of Search ..... 53/212; 133/1 A, 8 A

[56] References Cited

U.S. PATENT DOCUMENTS 3,938,303 2/1976 Ushio et al. ..... 53/212

4,058,954 11/1977 Asami ..... 53/212

*Primary Examiner*—John Sipos

*Attorney, Agent, or Firm*—Fleit & Jacobson; Fleit & Jacobson

[57] ABSTRACT

A coin packaging machine in which different kinds of coins are packaged is provided. The coin packaging machine is provided with a mechanism for supplying coins, a mechanism for transporting the supplied coins while selecting a kind of coins out during transportation, a mechanism for accumulating transported coins, a delivery mechanism for receiving accumulated coins and delivering the coins from receiving position to packaging position, a mechanism for supplying a web of paper within packaging zone and a mechanism for clamping the packaged coins. The coin packaging machine may further include a mechanism for making adjustments of various kinds of the above mechanisms in accordance with the thickness and the width of the coins to be packaged.

1 Claim, 10 Drawing Figures

COIN PACKAGING MACHINE

The present invention relates to a coin packaging machine in which peripheries of a predetermined number of accumulated coins are wrapped with a packaging paper and both the upper and lower edges of the packaging paper are inwardly bent by a pair of clamping claws to complete the packaging operation. The primary object of the present invention is to prevent the collapse or scattering of accumulated coins when the accumulated coins are delivered from an accumulating cylinder to a packaging mechanism by a delivery mechanism. According to the present invention, when the kind of coins to be treated is designated by a coin kind setting mechanism, adjusting members mounted on the coin kind setting mechanism are selected and positioned, and a member deciding the open position of a packaging mechanism is operated so that the operation position of the packaging mechanism is set by engagement with said member and the open position of the packaging mechanism is set so that a gap slightly larger than the diameter of the coins to be packaged is provided. When the accumulated coins are introduded to the packaging position of the packaging mechanism from the accumulating cylinder disposed above the packaging mechanism by the delivery mechanism, a plurality of packaging rollers and paper guide plates disposed between every two adjacent packaging rollers are made to perform a function of guiding the accumulated coins, whereby the collapse or scattering of the accumulated coins during the delivery can be effectively prevented.

The present invention will now be described in detail by reference to embodiments illustrated in the accompanying drawing.

Figure 1:
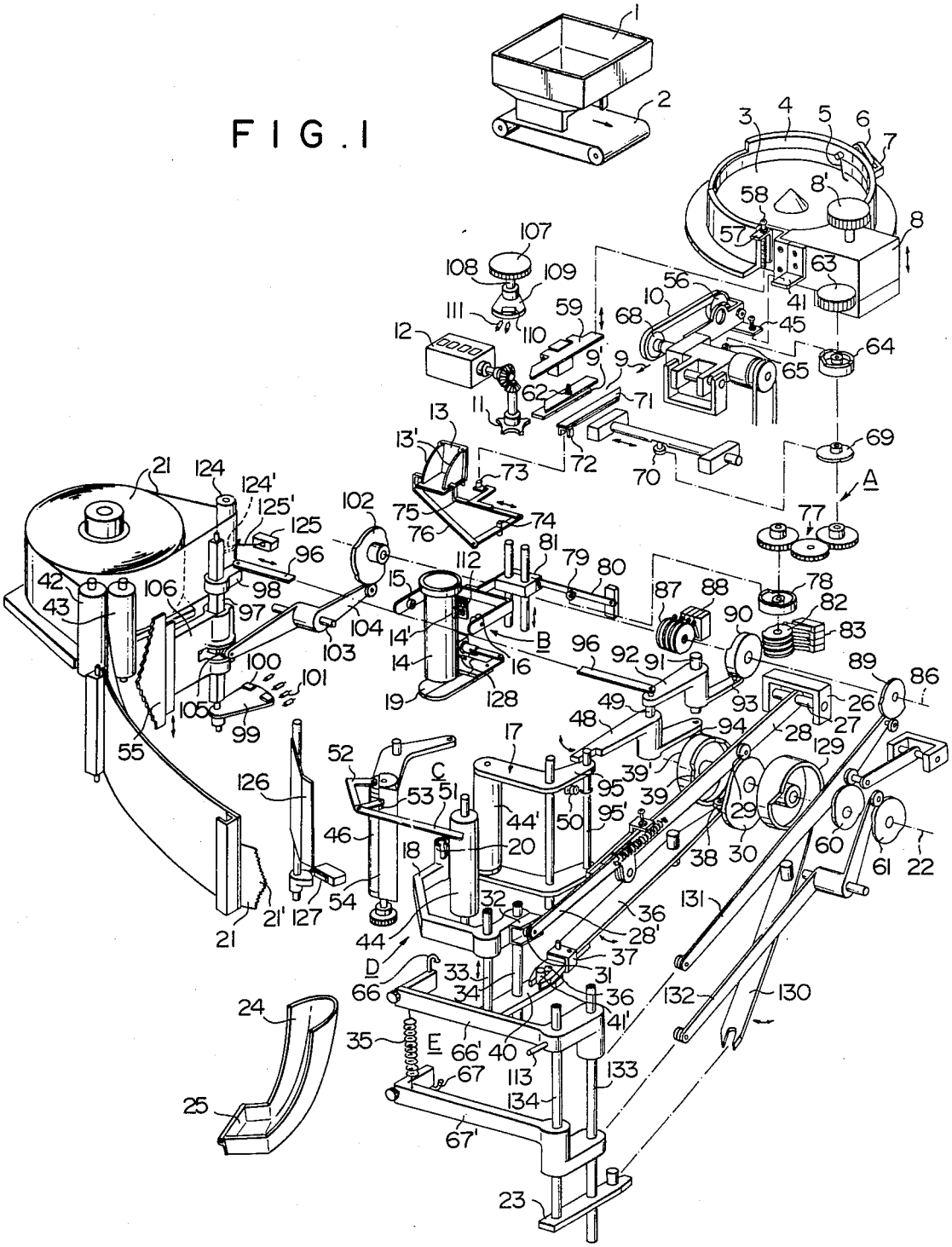
Figure 2:
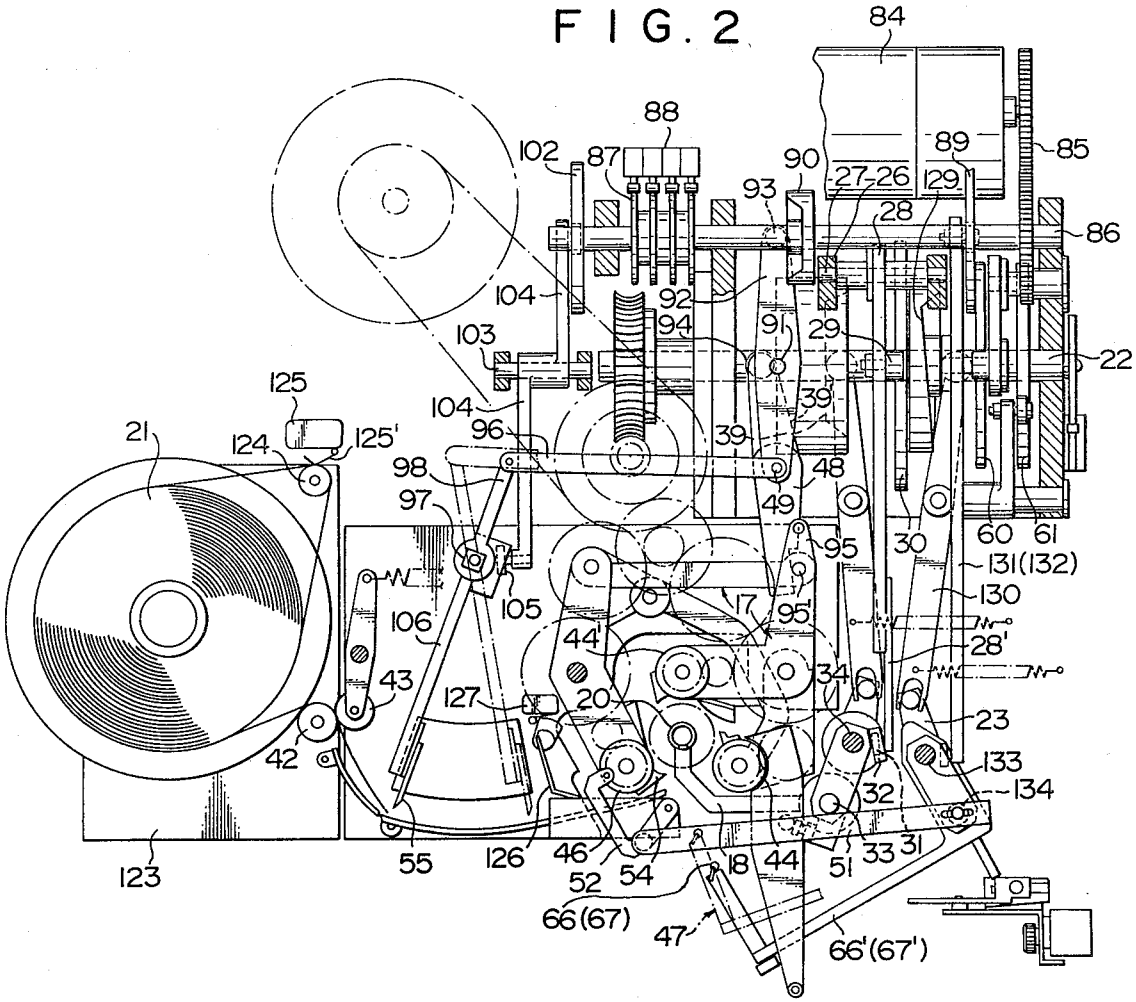
Figure 3:
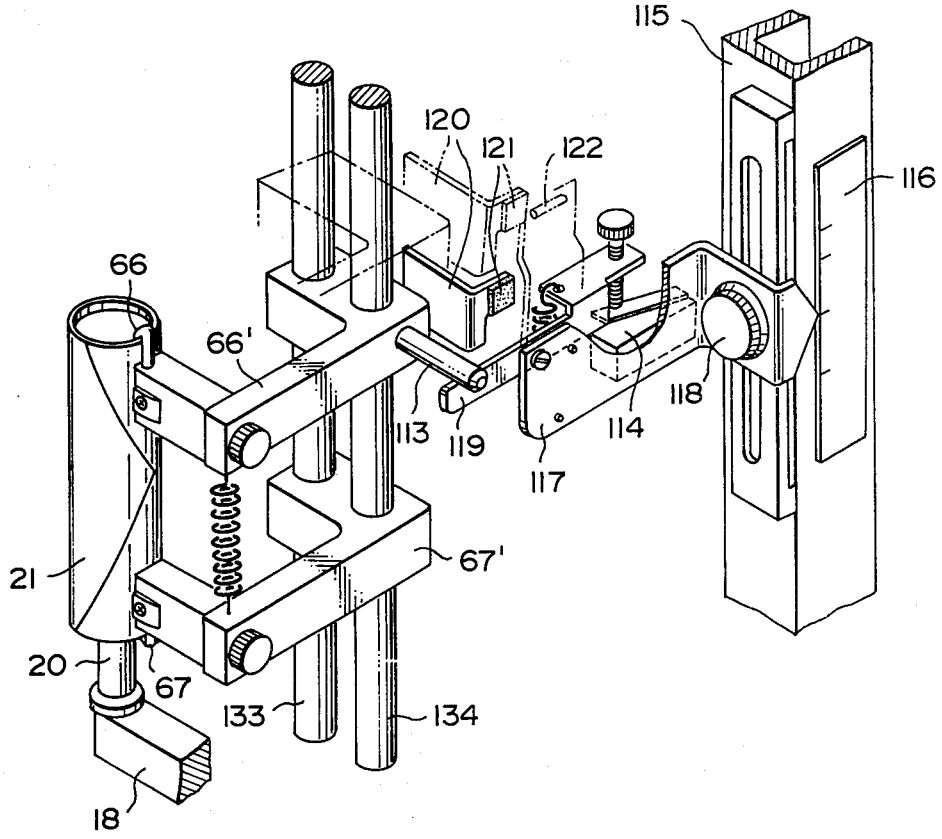
Figure 4:
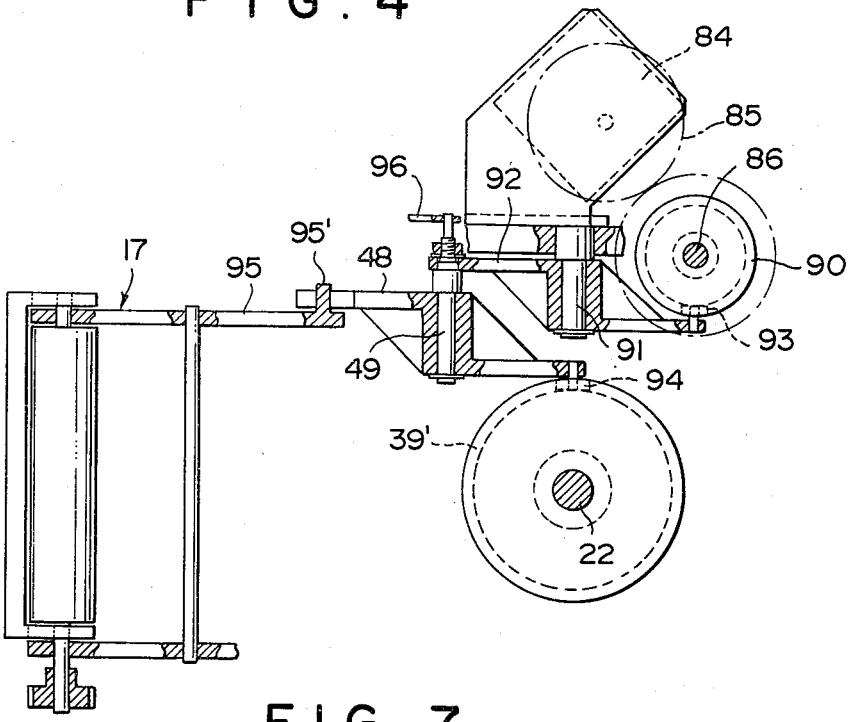
Figure 7:
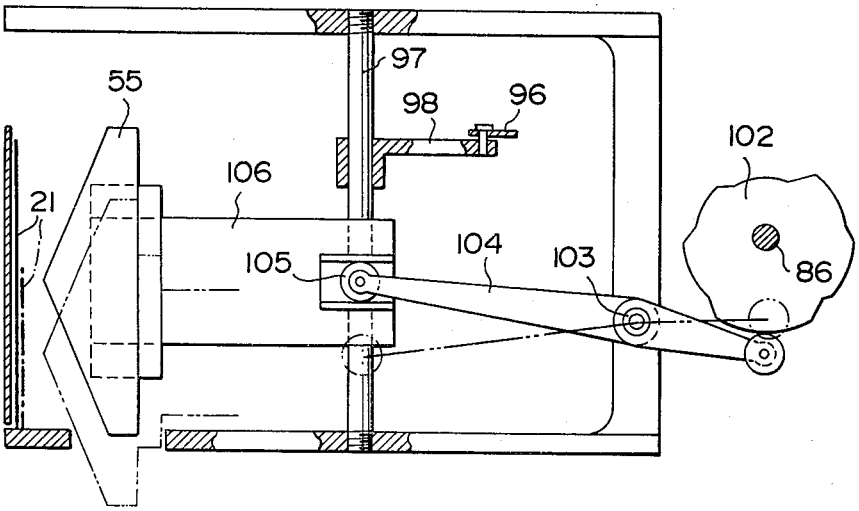
Figure 5:
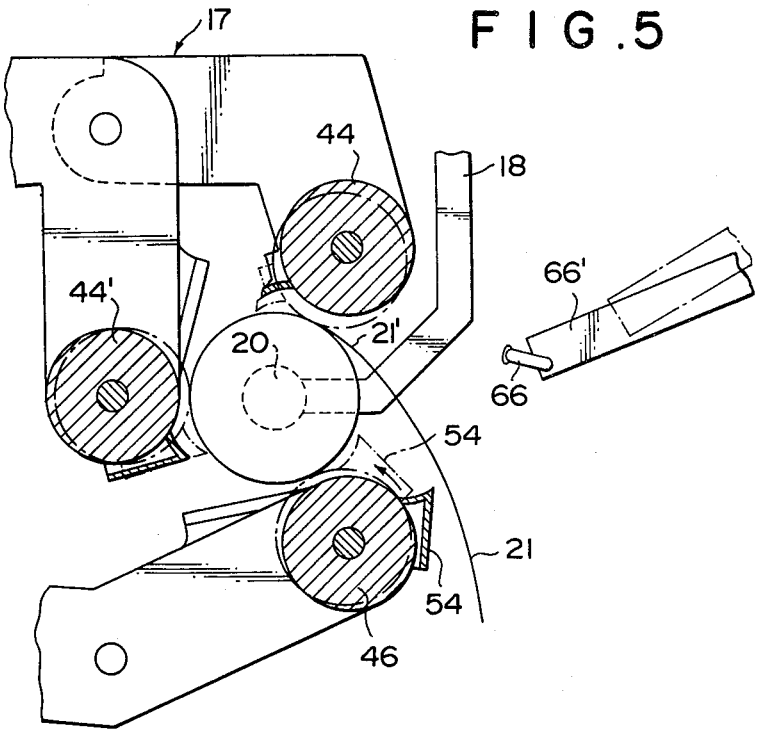
Figure 6:
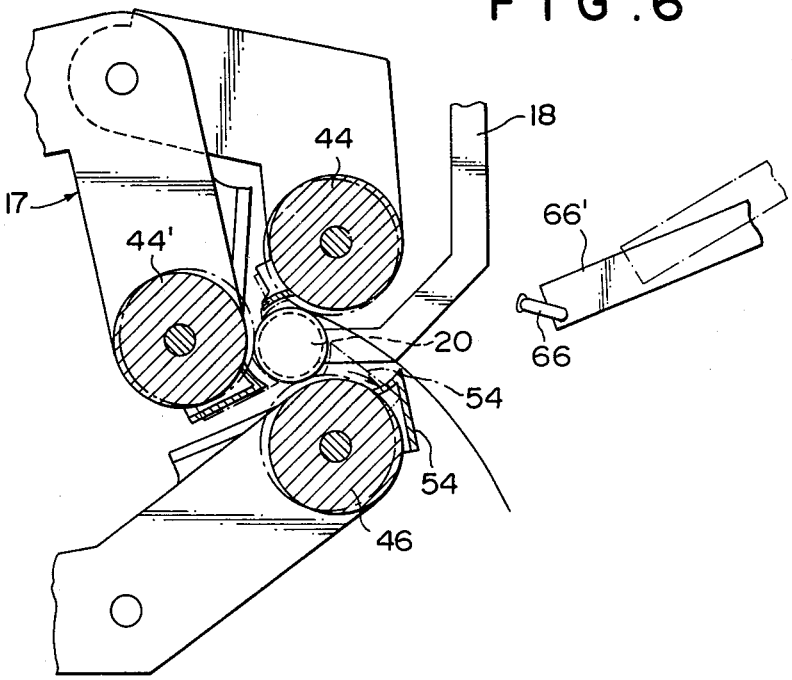
Figure 8:
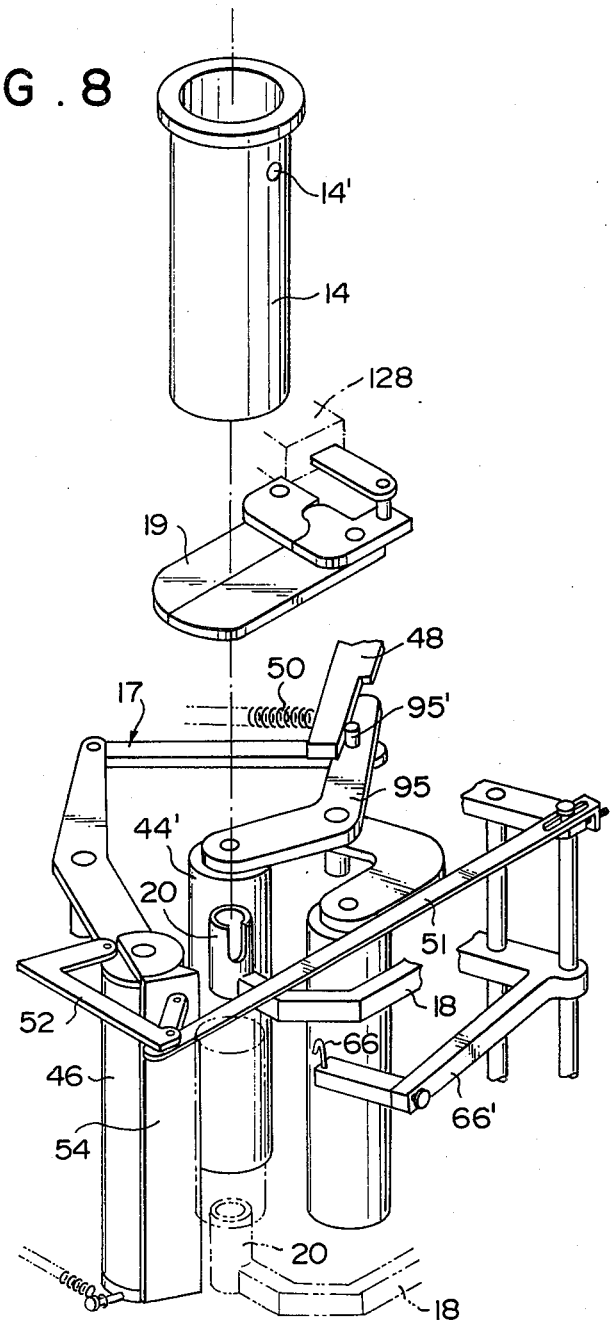
Figure 9:
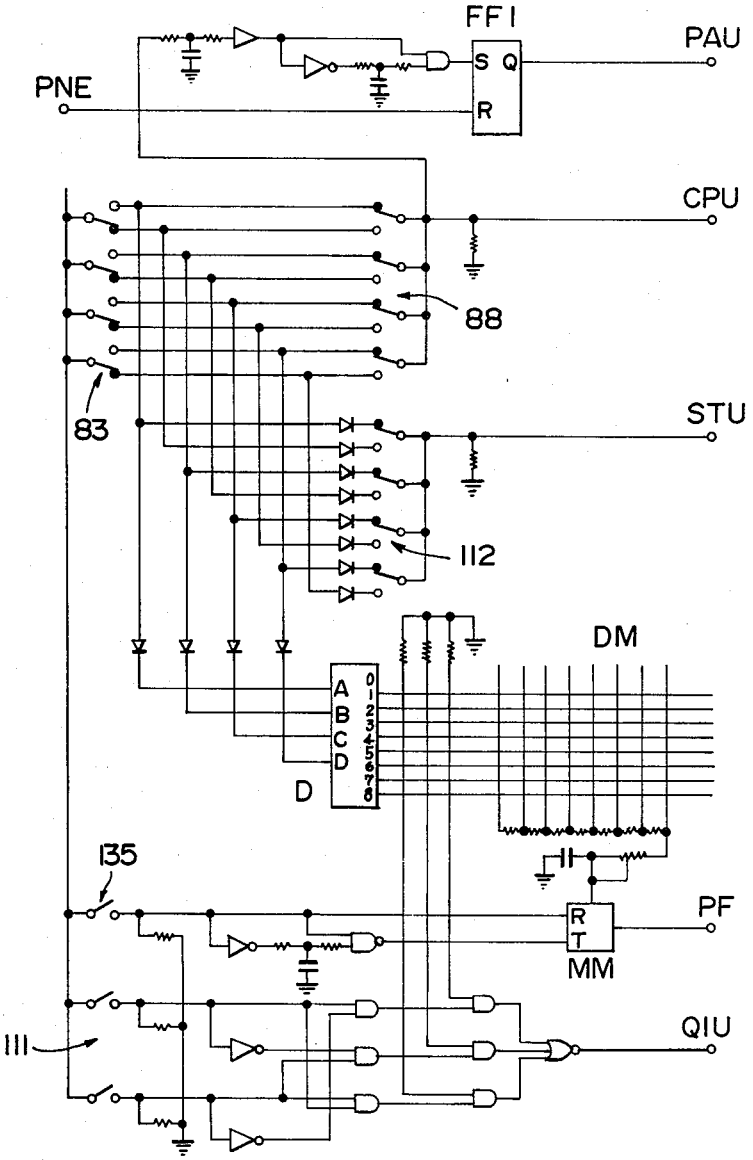
Figure 10:
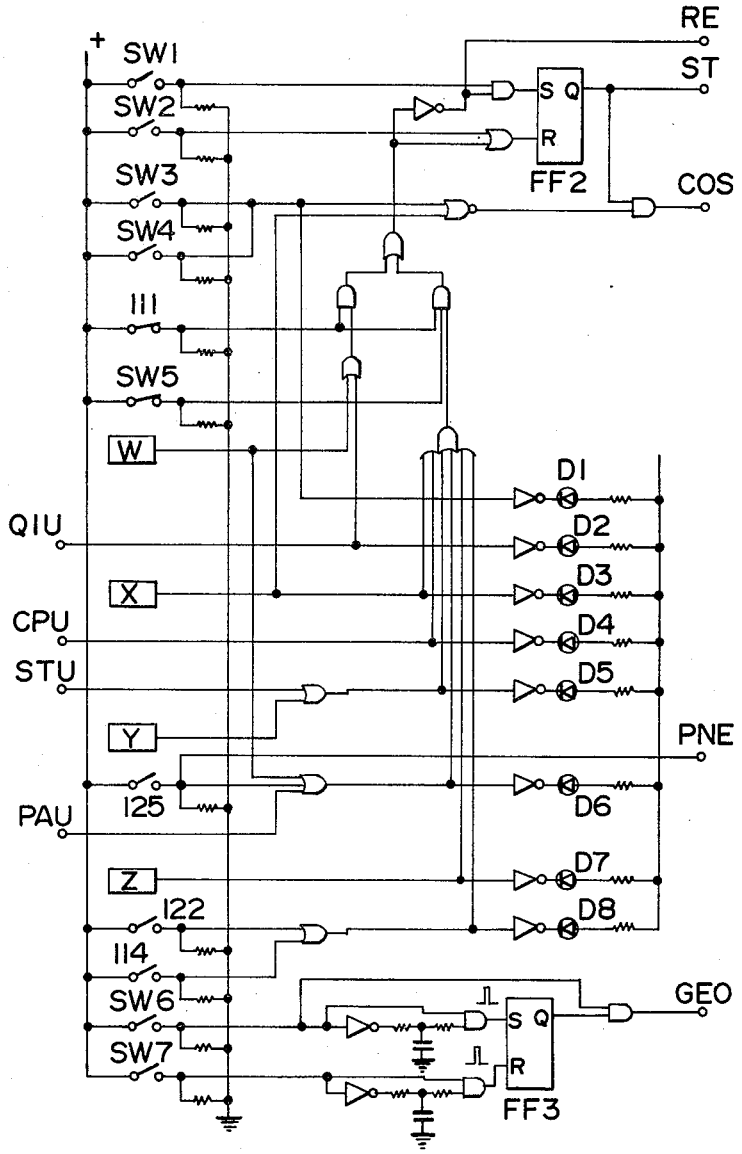

FIG. 1 is a fragmentary perspective view showing the entire structure of the coin packaging machine, FIG. 2 is a plan view showing the packaging mechanism, FIG. 3 is a perspective view illustrating the device for detecting the shortage of the number of packaged coins, FIG. 4 is a partial side view illustrating the device for adjusting the open position according to the diameter of coins, FIG. 5 is a partial plan view illustrating the operation relation between the paper guide plate and clamping arm in the packaging mechanism when large diameter coins are packaged, FIG. 6 is a partial plan view illustrating the same operation relation as in FIG. 5 when small diamter coins are packaged, FIG. 7 is a partial side view showing the movement of the cutting center position of the cutter, FIG. 8 is a perspective view illustrating the packaging mechanism, and FIGS. 9 and 10 are wiring diagrams illustrating an embodiment of the electric circuit of the apparatus of the present invention.

FIG. 1 is a perspective view illustrating the entire sturcture of a coin packaging machine. When coins to be treated are thrown into a hopper 1, they are fed to a rotary disc 3 by a conveyor belt 2. By the rotation force of the rotary disc 3, the coins are pressed to a circular side wall 4 and aligned in this state. The coins are thus delivered in the direction of rotation. When a sufficient number of the coins are aligned and piled at this point, a detecting lever 5 is lifted up by the accumulated coins to bring up a weight 6 disposed outside the side wall 4 and put off a switch 7 to stop a motor (not shown) for driving the conveyor belt 2. Accordingly, supply of the coins is interrupted. Thus, appropriate quantities of coins are always supplied to the rotary disc 3 automatically. The aligned coins are taken in one by one from a gap of a gap regulating block 8 adjusted by a gap setting member 8' exposed disposed adjacent to the rotary disc 3 in the coin kind setting mechanism A and fed to a coin passage 9. The coins are delivered astride of narrow selection rails 9' disposed on both the sides of the coin passage 9 in the state pressed by a delivery belt 10. At this point, different coins of a shorter diameter cannot be supported astride of the rails 9' but are let to fall down into a discharge opening (not shown) formed in the lower portion and stored in a separate part.

The coins being delivered along the coin passage 9 bear against a star gear 11, and every time one coin passes through the star gear 11, it is rotated by one tooth and in this manner, the number of the coins is counted and displayed by a displaying counter 12. Separately, counting is performed by a counting device (not shown) and when predetermined number is counted, counting is stopped and a signal is emitted.

The coins of which the number has been counted are guided to a chute 13 and are let to fall down into an accumulating cylinder 14. A predetermined number of coins are horizontally accumulated and the accumulation state is inspected through holes 14' piercing through the sides of the accumulating cylinder 14 by an irregularity detecting mechanism B comprising a light projector 15 and a light receiver 16. When the coins are correctly accumulated, a bottom shutter 19 is opened and the accumulated coins are placed on the top face of a supporting rod 20 mounted on the top end of a delivery lever 18 of a delivery mechanism D which has risen up and stands by for the delivery operation. Then, the delivery lever 18 is brought down and the coins are delivered to a packaging mechanism C.

If the coins are not correctly accumulated horizontally in the accumulating cylinder 14, the accumulation height of the coins is increased to intercept the light from the projector 15 by the coins and the irregular accumulation is detected. In this case, even if the delivery lever 18 rises up for receipt of the accumulated coins, the shutter 19 is not opened and a packaging paper 21 is not fed out. Further, a driving motor described hereinafter by reference to FIG. 2 is rotated in a reverse direction to rotate a cam shaft 22 or the packaging mechanism C in a reverse direction, and the delivery lever 18 is returned to the original predetermined position and stands by at this position. Substantially at the time, the shutter 19 is opened and the coins in the accumulating cylinder 14 are let to fall down in the irregular state, and they are blocked by closing of a gate 25 mounted on the top end of a roll chute 24 and operated by a linking mechanism or electromagnetic device or they are stored in a separate part by opening of the gate 25. Thus, the operation of the machine is stopped.

The operation of the delivery mechanism D will now be described.

A vertical operation lever 28 is supported on a shaft 27 piercing through a bracket 26, and a cam follower 29 is rotatably mounted in the midway of the lever 28 and is engaged with a cam 30 of the cam shaft 22. The cam follower 29 is always pressed to the cam 30 by a spring (not shown).

A roller 31 is rotatably attached to the top end of the vertical operation lever 28 and is engaged with a guide 32 of the delivery lever 18 to move up and down on vertical shaft 33 and guide shaft 34 mounted on a receiving plate 40 along a predetermined cam curve.

The front portion 28' of the vertical operation lever 28 is bent only downwardly so that no abnormal force is imposed at the failure of the packaging operation or other time. A horizontal operation lever 36 acting in the horizontal direction is disposed to move and retreat the delivery mechanism D to and from the central position of the packaging mechanism C and a forked engaging groove 36' is formed on one end of the lever 36. The lever 36 is arranged so that it is bent in one direction on the horizontal plane from an intermediate bent portion 37. A cam follower 38 is rotatably attached to the other end of the lever 36 and the cam follower 38 bears against a face cam 39. Since a pin 41' of the receiving plate 40 disposed in the lower portion of the delivery mechanism D is engaged with the forked engaging groove 36', the movement of the delivery mechanism D in the horizontal direction is regulated by the curve of the face cam 39.

Substantially at the same time when the accumulated coins are delivered to the packaging position of the packaging mechanism C by the supporting rod 20 of the delivery mechanism D, a clamping mechanism E retreats in a direction further separating from the packaging mechanism C. Accordingly, a linking lever 52 connected to a linking lever 51 connected to the clamping mechanism E is operated with a pin 53 being as the center, and hence, a paper guide plate 54 rotatably mounted coaxially with a packaging roller 46 is rotated in a direction approaching to the accumulated coins to block the gap between the packaging rollers 46 and 44 and prevent the collapse of the accumulated coins. In the ordinary state, this gap is kept in the free state because the delivery lever 18 or clamping arm 66' or 67' is inserted in this gap. It is possible to adapt a modification in which this gap is especially broadened for facilitating insertion of the delivery lever 18 or the clamping arms 66' and 67' and the collapse of the accumulated coins is prevented by the paper guide plate 54.

Then, the top end 21' of the packaging paper 21 fed out by rotation of paper feed rollers 42 and 43 intrudes into the gap between the packaging roller 44 and the accumulated coins and an opening and closing lever 48 operated by a face cam 39' on the back side of the face cam 39 is turned with a shaft 49 being as a fulcrum. At this point, three packaging rollers 44,44' and 46 are simultaneously moved toward the center through a link member 17 by the tensile force of a spring 50 to press and grip the peripheral faces of the accumulated coins, and the packaging paper 21 is wound around the peripheries of the accumulated coins by rotation of the packaging rollers 44,44' and 46. When an appropriate quantity of the packaging paper 21 is wound, the slack is removed from the packaging paper 21 because of the difference of the speed between the paper feed rollers 42 and 43 and the packaging rollers 44,44' and 46, and the stretched paper 21 is pressed to a cutter 55, cut by the cutter 55 and wound up.

Then, the clamping mechanism R is turned and brought close to the packaging mechanism C by an operation lever 130 engaged with a face cam 129 of the cam shaft 22, and the paper guide plate 54 is retreated in the opposite direction so that it is separated from the accumulated coins. The upper and lower clamping arms 66' and 67' are brought into contact with the accumulated coins through the packaging paper 21.

When the top ends of operation levers 131 and 132 engaged with plate cams 60 and 61 on the cam shaft 22 are engaged with the lower face and upper face of the upper and lower clamping arms 66' and 67', respectively, the upper clamping arm 66' is brought down by a stored force of a spring 35 while being guided by vertical shaft 133 and guide shaft 134 on the receiving plate 23, and the lower clamping arm 67' is lifted up by the same spring 35, whereby both the upper and lower edges of the packaging paper wound in the form of a cylinder are inwardly bent and clamped by both the clamping claws 66 and 67. When this clamping operation is almost completed, the delivery lever 18 is further brought down below the position for supporting the accumulating coins, and the supporting rod 20 is separated from the accumulated coins and then from the central position, retreated outwardly through between the packaging rollers 44 and 46 and stands by at the retreated position.

When the clamping operation by the clamping claws 66 and 67 is completed, the upper clamping arm 66' is lifted up and the lower clamping arm 67' is brought down, and they are separated from the accumulated coins, are turned in the horizontal direction to separate from the packaging mechanism C and stand by at the first stage retreat position 47 (see FIG. 2). This stand-by position 47 of the clamping mechanism E is set so that the gap between the paper guide plate 54 and the packaging roller 44 is sufficient to guide the accumulated coins to the packaging mechanism C.

The packaging rollers 44, 44' and 46 of the packaging mechanism C release the accumulated coins from the gripping action and the accumulated coins are let to fall down into the roll chute 24 located below and once stopped by the gate 25 on the top end of the chute 24. The gate 25 is opened at an appropriate timing by a cam mounted on the cam shaft 22 or an electromagnetic device (not shown) and the coins are stored in a box or the like.

The operation on change of the kind of coins to be treated will now be described. Incidentally, a one-dot chain line in FIG. 1 indicates a direct or indirect transmission system.

According to the thickness of coins to be treated, a gap setting member 8', for example, a handle, is operated to bring up or down a gap regulating block 8 so that the gap between the block 8 and the rotary disc 3 is set in agreement with the thickness of the coins. Also a feed arm 45 engaged with the top face of an L-shaped fitting 41 fixed to the block 8 is brought up or down to determine the height of a feed pulley 56 located on the side of the rotary disc 3, so that an appropriate bite-in condition can be attained in the coins which are fed one by one.

A gap regulating plate 59 on the side of the coin passage 9, which is anchored by an adjusting screw mounted on a reversed L-shaped fitting 57 fixed to the top end of the block 8, is always pushed upwardly by a compression spring 62 and therefore; the gap of the coin passage 9 is determined simultaneously with positioning of the block 8.

Then, a coin kind setting member 63, for example, a handle, of the coin kind setting mechanism A is operated according to the kind of the coins to be treated. At this point, the gap between the other feed pulley 68 and the coin passage 9 is determined by a roller 65 engaged with an adjusting cam 64, and also the width of the coin passage 9 is determined according to the diameter of the coins to be treated by means of a roller 70 engaged with a diameter cam 69.

By a pin 73 freely fitted in an engaging plate 72 fixed to a standard plate 71 constituting the coin passage 9 on the movable side thereof, the distance between both the left and right side walls 13' of the chute 13 connected to operation levers 75 and 76 co-operating with a shaft 74 being as the center is adjusted so that a guide passage to the accumulating cylinder 14 is formed according to the diameter of the coins to be treated.

The irregularity detecting mechanism B is adjusted according to the height of the accumulated coins by an irregularity detecting cam 78 turned through gears 77. More specifically, by a sliding block 81 operated by a lever 80 to which a roller 79 engaged with the irregularity detecting cam 78 is fixed, the positions of the light projector 15 and light receiver 16 are determined in agreement with through holes 14' formed on the accumulating cylinder 14 in the diameter direction thereof.

Four selection switch cams 82 are disposed coaxially with the irregularity detecting cam 78 and by selecting an appropriate combination in their contacts with corresponding four selection switches 83, the kind of the coins to be selected is selected, and a setting motor 84 shown in FIGS. 2 and 4 starts rotation and a setting shaft 86 is rotated co-operatively with a driving gear 85 attached to the shaft of the motor 84. When a combination of contacts selected between four setting switch cams 87 and corresponding four setting switches 88 is in agreement with the above-mentioned combination of the contacts of the selecting switches 83, the rotation of the setting motor 84 is stopped to set the position of the setting shaft 86.

By an initial position setting cam 89 mounted on the setting shaft 86, the height of the initial position for starting the clamping operation of the upper clamping claw 66 is determined according to the height of the accumulated coins.

By an open position setting cam 90 mounted on the setting shaft 86 to determine the open gap among the respective packaging rollers 44,44' and 46, the positions of these rollers 44,44' and 46 are set according to the diameter of the coins to be treated so that a gap slightly larger than the diameter of the coins is provided and the accumulated coins are smoothly advanced when they are introduced. More specifically, a roller 93 mounted on one end of setting lever 92 turning with a shaft 91 being as the center is engaged with the open position setting cam 90, and a shaft 49 is fixed to the other end of the lever 92 and an opening and closing lever 48 is disposed so that it can turn with the shaft 49 being as the center. A roller 94 mounted on one end of the opening and closing lever 48 is engaged with the face cam 39' and the other end of the lever 48 is engaged with a shaft 95' piercing through an arm 95 of the link member 17 supporting the packaging roller 44'. Accordingly, when the face cam 39' is rotated, the packaging rollers 44', 44 and 46 are contracted from the open positions through the link member 17 along the cam curve of the face cam 39' and operated in the direction supporting and gripping the coins. Since a linking rod 96 connected to the same end portion of the setting lever 92 is connected to a lever 98 mounted on a cutter shaft 97, the rod 96 is turned co-operatively with setting of the packaging mechanism C according to the diameter of the coins and the cutting position of a cutter 55 is automatically set according to a necessary length of the packaging paper 21. At this point, a magnet attachment plate 99 mounted below the cutter shaft 77 is simultaneously turned and by a magnet 100 disposed in the vicinity of the periphery of the plate 99, a predetermined switch among four switches 101 is actuated to set a feed length of the packaging paper 21 according to the diameter of the coins. When the cutting position of the cutter 55 is manually set, these switches 101 can be used as reference switches for preventing nonperformance of setting or mis-setting.

The operation of a cutter cam 102 mounted on the setting shaft 86 will now be described. Since the cutter cam 102 has already been set at the selected position, an operation lever 104 having one end contacted with the cutter cam 102 is turned with a shaft 103 being as the center, and a holding arm 106 of the cutter 55 is engaged with a roller 105 mounted on the other end of the operation lever 104 and is brought up to a position corresponding to the height of the accumulated coins according to the predetermined cam curve of the cutter cam 102. Accordingly, the cutter 55 mounted on the top end of the holding arm 106 is automatically arranged so that the cutting center of the cutter 55 agrees with the center of the packaging paper 21 with respect to the widthwise direction irrespective of the width of the cutting paper 21.

Setting of the number of coins to be packaged will now be described.

The number of coins to be packaged is varied according to the kind of coins. For example, 20, 40 or 50 coins are packaged. Therefore, if the number of coins to be packaged is not preliminarily selected according to the kind of coins to be treated, the clamping margin of the packaging paper 21 becomes insufficient or excessive according to the accumulation height of the coins and the packaging operation ends in a failure. Accordingly, in the present invention, when a certain coin kind is selected by the coin kind setting member 63, the machine is not operated until the coin number predetermind according to this kind is properly set. When a handle of a number setting member 107 is operated so that the predetermined number is set in a counting device (not shown) (electronic or mechanical counting device), a contact of any of two swithces 111 (the number of the switches is not critical but optional) is actuated by a magnet 110 attached in the vicinity of a lever 109 mounted on a shaft 108 to compare the combination of contacts among the selection switches 83 with the contact selected in the switches 111, and if the contacts are properly arranged, the operation of the machine becomes possible for the first time.

Selection, attachment, dismounting and exchange of the accumulating cylinder 14 will now be described.

When the kind of coins to be treated is changed, also the accumulating cylinder 14 is exchanged with one conforming with the diameter of coins to be treated and is set at a predetermined position. The inner diameter of the accumulating cylinder 14 is determined according to the diameter of coins. Accordingly, if exchange of the accumulating cylinder 14 is forgotten, an accumulating cylinder not meeting with the coin kind is set or if any accumulating cylinder 14 is not set, coins are held up or they are not accumulated in good conditions, and therefore, an accident of scattering of the coins in the machine is caused. Accordingly, a detecting device is disposed to detect such trouble.

A plurality of detecting switches 112 (four switches in the embodiment shown in the drawing) are disposed to confront the accumulating cylinder 14, and one or a plurality of operation pieces (not shown) are disposed on the back side of the accumulating cylinder 14 to confront any of the switches 112.

Accordingly, if any contact of the selection switches 83 co-operating with the coin kind setting member 63 is appropriately combined with any contact of the detecting switches 112, it is seen that a correct accumulating cylinder 14 is set, and the operation of the machine becomes possible. When it is detected that a proper accumulating cylinder is not set, an alarm is given and the operation of the machine is not allowed.

A method for detecting whether or not a predetermined number of coins are correctly packaged will now be described.

When the accumulated coins are delivered from the accumulating cylinder 14 to the packaging position of the packaging mechanism C while being supported by the supporting rod 20, if it happens that some coins are caused to fall down during the delivery because of an improper accumulation state or the like, the number of coins packaged is smaller than the predetermined number. In order to prevent occurrence of this accident, when the accumulated coins are clamped by the clamping claws 66 and 67, the number of the coins is checked based on the accumulation height of the coins. Since coins of one kind are equal in the thickness, the accumulation height of the predetermined number of coins can be seen in advance. Accordingly, when the coins are packaged, the top end of the upper clamping claw 66 falls in contact with the coin surface at substantially the same position, and hence, the quantity of the lowering of the clamping claw 66' is always substantially constant. Accordingly, as shown in FIG. 3, an operation pin 113 is projected from the side of the upper clamping arm 66', and if a detecting switch 114 is set to an indication of a coin kind indicating plate 116 mounted on a post 115 of the machine and an attachment fitting 117 is set and fixed at a selected position by a fixing screw 118, when the predetermined number of coins are correctly packaged, the operation pin 113 does not fall in contact with an operation lever 119 actuating the detecting switch 114. However, if the number of the packaged coins is smaller than the predetermined number, the upper clamping arm 66 is brought down excessively by a length corresponding to the thickness of lacking coins and therefore, the operation pin 113 bears against the operation lever 119 and pushes it downward. Accordingly, the detecting switch 114 is actuated to emit a signal indicating the shortage of the packaged coins.

The initial position of the upper clamping arm 66' can be automatically set by the handle operation of the coin kind setting member 63, but in the embodiment shown in the drawing, setting of the detecting switch 114 is manually performed. Accordingly, if setting is forgotten or misconducted, the packaging operation is miscarried. In order to prevent such failure, an operation piece 121 is mounted on the top end of an attachment plate 120 extended from the upper clamping arm 66' and a switch 122 to be actuated by the operation piece 121 is mounted on one end of the attachment fitting 117. If setting is correctly performed according to the kind of coins to be treated by an operator, the switch 122 is located at a position facing the operation piece 121 and is actuated to indicate that the detecting switch 114 is set at the correct position, and the machine is kept in the state where the operation is possible.

When setting is forgotton or misconducted, the switch 122 is not actuated but an alarm signal is emitted.

In the embodiment illustrated in the drawing, one switch 122 is disposed but of course, it is possible to adopt a method in which contacts of a plurality of switches are appropriately combined as described hereinbefore with respect to other functions.

The operation of feeding out the packaging paper 21 and other operations will now be described.

An idle roller 124 is mounted on one side of a charge stand 123 (see FIG. 2) for the packaging paper 21, and a concave groove 124' is formed in the midway of the idle roller 124. A near end switch 125 is mounted at a position facing the groove 124' and after the packaging paper 12 is inserted between an operation piece 125' of the near end switch 125 and the idle roller 124, the top end of the packaging paper is pulled out in the state supported between the paper feed rollers 42 and 43. Then, the top end 21' of the packaging paper 21 is cut in a V-figured shape by the cutter 55 and setting of the packaging paper 21 is completed.

When the packaging paper 21 is used and consumed and the operation piece 125' of the near end switch 125 is let to fall into the concave groove 124' of the idle roller 124, the near end switch 125 is actuated, but feeding of the packaging paper 21 is continued and the machine is stopped for the first time after the packaging paper 21 for the packaging operation of this cycle is completely fed and packaging is accomplished. When the length of the packaging paper 21 is set through the idle roller 124 in the foregoing manner, if the idle roller 124 is located so that the length of the cut packaging paper 21 is slightly larger than the length necessary for packaging one set of the accumulated coins, even the last set of the accumulated coins can be completely packaged.

Reference numeral 125 represents a plate detecting cutting of the paper, which is actuated at the time of cutting the packaging paper 21 to put in a switch 127 of a paper cutting detecting circuit. Reference numeral 128 represents a solenoid. When the solenoid 128 is energized, the shutter 19 is opened and the accumulated coins are supported by the supporting rod 20.

An embodiment of the electric system that is used in the apparatus of the present invention will now be described by reference to FIGS. 9 and 10.

When the packaging paper 21 is not charged, a PNE signal indicating the absence of the packaging paper is put out from the near end switch 125 shown in FIG. 10, and this signal as well as other signals described hereinafter actuates a luminous diode D6 through a gate. Thus, it is seen that inspection of the packaging paper is necessary.

When the coin kind setting member 63 is set according to the kind of coins to be packaged, appropriate selection switches 83 are selected and the position, i.e., the height, of the light projector 15 and light receiver 16 of the irregularity detecting mechanism B is determined. Simultaneously, the setting shaft 86 begins to turn as described hereinbefore to set the setting switches 88. If the setting state is not proper, a signal indicating nonconformity of the claw positions appears at a CPU terminal and a luminous diode D4 is actuated and an alarm is given. This non-conformity signal is put in a set terminal of a flip-flop FF1 to emit to a PAU terminal a signal indicating non-conformity of the paper and the luminous diode D6 is actuated through the gate. Simultaneously, the output of the paper cutting detecting circuit w including the switch 127 actuates the diode D6.

When the paper non-conformity signal is put out to the PAU terminal, the paper charge stand is once taken out and a paper corresponding to the selected coin kind is set to the stand, and the PNE signal indicating the absence of the packaging paper is sent to the reset terminal of a flip-flop FF1 to reset the flip-flop FF1. Thus, the paper non-conformity signal disappears.

By non-conformity in the correspondence between the detecting switches 112 of the accumulating cylinder 14 and the selection switches 83, an accumulating cylinder non-conformity signal appears at a terminal STU to actuate a luminous diode D5, and it is seen that the accumulating cylinder 14 is erroneously attached. The coin kind selecting signals are put in a diode matrix DM through a decorder D and further transmitted to a mono-multivibrator MM together with a signal of the paper feed switch 135 (see FIG. 9) to be actuated by the paper feed cam rotated by the packaging cam shaft 22. When the rotation quantity is equal in the paper feed rollers 42 and 43, a delay signal actuating a clutch device (not shown) to impart an appropriate quantity of rotation to the rollers 42 and 43 is given to a terminal PF, and the length of the packaging paper corresponding to the coin kind is set by the coin kind selecting switches.

When switches 111 for setting the number of the coins to be packaged to, for example, 20 or 50, are not in conformity with switches selected in the selection switches 83, a coin number non-conformity signal appears at a QIU terminal to actuate a luminous diode D2, and it is seen that inspection of the number of coins to be packaged is necessary.

SW2 stands for a manual switch for emergency stop, and SW3 and SW4 are door switches disposed in the counting zone and packaging zone, respectively. These door switches are automatically closed when doors are completely shut. When shutting of the doors is incomplete, a luminous diode D1 is actuated and incomplete shutting is indicated.

SW5 stands for a switch for operating a one-rotation cam (not shown) attached to the cam shaft 22 and a one-rotation stop switch (not shown) for said cam. X stands for a coin feed detecting circuit disposed in the vicinity of the star gear 11 in the coin passage 9 to detect the feed state of coins. When the coin feed state is not proper, a luminous diode D3 is actuated and it is seen that inspection of the coin feed state is necessary.

An irregularity detecting circuit Y is disposed in the irregularity detecting mechanism B so that the state where the coins are not correctly piled but they are accumulated, for example, in a slant manner is detected through the light projector 15 and light receiver 16.

A timing detecting circuit Z is disposed that when the above-mentioned one-rotation operation is not accurately performed in the cam shaft 22, a luminous diode D7 is actuated. The switch 122 detects whether or not the packaged number detecting switch 114 is set at a position corresponding to the kind of coins to be packaged. When the setting position is not correct, a luminous diode D8 is actuated through the detecting switch 114 and gate.

The foregoing switches 114 and 122, timing detecting circuit Z, near end switch 125, irregularity detecting circuit Y, terminals STU, CPU and QIU, coin feed detecting circuit X, paper cutting detecting circuit W and switches SW 5 and 111 are connected to the start output ST through respective gates and flip-flop FF2. Accordingly, when a signal is transmitted to the terminal RE de-energizing the diodes D1 to D8, it is notified that preparation for the operation is completed, and when the start switch SW1 is closed to set the flip-flop FF2 and send the start output to the terminal ST, a signal starting the counting circuit is transmitted to the terminal COS through a gate.

The timing switch SW6 actuated by the cam of the cam shaft 22 and the shutter opening switch SW7 actuating the solenoid 128 for opening the shutter 19 put out a signal for opening the gate 25 to the terminal GEO through a flip-flop 3.

Switches 101 are disposed so that the cutter can be manually set. When the cutter is not correctly located at the cutter position corresponding to the coin kind selected by the coin kind selecting switches, a cutter position non-conformity signal is put out.

Even if the above-mentioned diode matrix is not used, the length of the packaging paper corresponding to the coin kind can be set by utilizing the switches 101 and the paper feed switch 135.

What is claimed is:

1. A coin packaging machine in which distances between coins to be packaged and each of packaging rollers in non-packaging operation position are simultaneously adjusted in accordance with the kind of coins to be packaged which comprises:

a setting shaft (86) set at a given angle in accordance with the kind of coins, a first cam (90) mounted on said setting shaft (86), a setting lever (92) rotatable about a shaft (91) positioned between its opposite ends and engaging at the one end thereof with said first cam (90), an opening and closing lever (48) rotatable about a rotary shaft (49) provided on the other end of said setting lever (92), a second cam (39) engaging with one end of said opening and closing lever (48) for moving each of packaging rollers (44, 44', 46) between packaging operation position and non-packaging operation position, and a link member (17) operatively associated with the other end of said opening and closing lever (48) and operatively connected to each of packaging rollers (44, 44', 46), whereby distances between coins to be packaged and each of packaging rollers in non-packaging operation position are simultaneously adjusted by setting said setting shaft at a given angle.

* * * * *